US006848137B1

(12) United States Patent
Barnes

(10) Patent No.: US 6,848,137 B1
(45) Date of Patent: Feb. 1, 2005

(54) INCLINE-ADJUSTABLE AIR MATTRESS

(76) Inventor: Christopher A. Barnes, 17601 Clagett Landing Rd., Upper Marlboro, MD (US) 20774

( * ) Notice: Subject to any disclaimer, the term of this patent is extended or adjusted under 35 U.S.C. 154(b) by 0 days.

(21) Appl. No.: 10/644,178

(22) Filed: Aug. 21, 2003

(51) Int. Cl.[7] ..... A47C 27/10
(52) U.S. Cl. ..... 5/710; 5/615
(58) Field of Search ..... 5/710, 713, 615, 5/706, 644, 655.3

(56) References Cited

U.S. PATENT DOCUMENTS 4,639,960 A * 2/1987 Quillen et al. ..... 5/710
4,873,731 A * 10/1989 Williamson ..... 5/615
4,941,221 A * 7/1990 Kanzler ..... 5/615
5,170,522 A * 12/1992 Walker ..... 5/615
5,311,625 A * 5/1994 Barker et al. ..... 5/615
5,345,630 A * 9/1994 Healy ..... 5/708
5,577,278 A * 11/1996 Barker et al. ..... 5/615
5,815,862 A * 10/1998 Rygiel ..... 5/632
5,970,545 A * 10/1999 Garman et al. ..... 5/615
6,012,186 A * 1/2000 Soltani et al. ..... 5/614
2004/0143906 A1 * 7/2004 Kasatshko et al. ..... 5/713

* cited by examiner

*Primary Examiner*—Alexander Grosz

(57) ABSTRACT

An incline-adjustable air mattress for elevating a user's head and legs relative to the user's torso. The incline-adjustable air mattress includes a base section having top, bottom and perimeter walls, and also having air valve members being disposed in the perimeter wall, and further having an air chamber disposed between the top, bottom, and perimeter walls; and also includes intermediate sections being disposed upon and connected to the base section; and further includes upper sections being disposed upon and connected to the intermediate sections.

3 Claims, 2 Drawing Sheets

INCLINE-ADJUSTABLE AIR MATTRESS

BACKGROUND OF THE INVENTION

1. Field of the Invention

The present invention relates to incline air mattresses and more particularly pertains to a new incline-adjustable air mattress for elevating a user's head and legs relative to the user's torso.

2. Description of the Prior Art

The use of incline air mattresses is known in the prior art. More specifically, incline air mattresses heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,170,522; U.S. Pat. No. 5,577,278; U.S. Pat. No. 4,639,960; U.S. Pat. No. 5,311,625; U.S. Pat. No. 5,345,630; and U.S. Patent No. Des. 359,189.

While these devices fulfill their respective, particular objectives and requirements, the aforementioned patents do not disclose a new incline-adjustable air mattress. The prior art includes air mattresses having air chambers but not to the extent of the present invention.

SUMMARY OF THE INVENTION

The general purpose of the present invention, which will be described subsequently in greater detail, is to provide a new incline-adjustable air mattress which has many of the advantages of the incline air mattresses mentioned heretofore and many novel features that result in a new incline-adjustable air mattress which is not anticipated, rendered obvious, suggested, or even implied by any of the prior art incline air mattresses, either alone or in any combination thereof. The present invention includes a base section having top, bottom and perimeter walls, and also having air valve members being disposed in the perimeter wall, and further having an air chamber disposed between the top, bottom, and perimeter walls; and also includes intermediate sections being disposed upon and connected to the base section; and further includes upper sections being disposed upon and connected to the intermediate sections. None of the prior art includes the combination of the elements of the present invention.

There has thus been outlined, rather broadly, the more important features of the incline-adjustable air mattress in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new incline-adjustable air mattress which has many of the advantages of the incline air mattresses mentioned heretofore and many novel features that result in a new incline-adjustable air mattress which is not anticipated, rendered obvious, suggested, or even implied by any of the prior art incline air mattresses, either alone or in any combination thereof.

Still another object of the present invention is to provide a new incline-adjustable air mattress for elevating a user's head and legs relative to the user's torso.

Still yet another object of the present invention is to provide a new incline-adjustable air mattress that is easy and convenient to set up and use.

Even still another object of the present invention is to provide a new incline-adjustable air mattress that reduces the incidence of gastro-esophagus influx, respiratory conditions, and pain and discomfort following surgery or injury.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
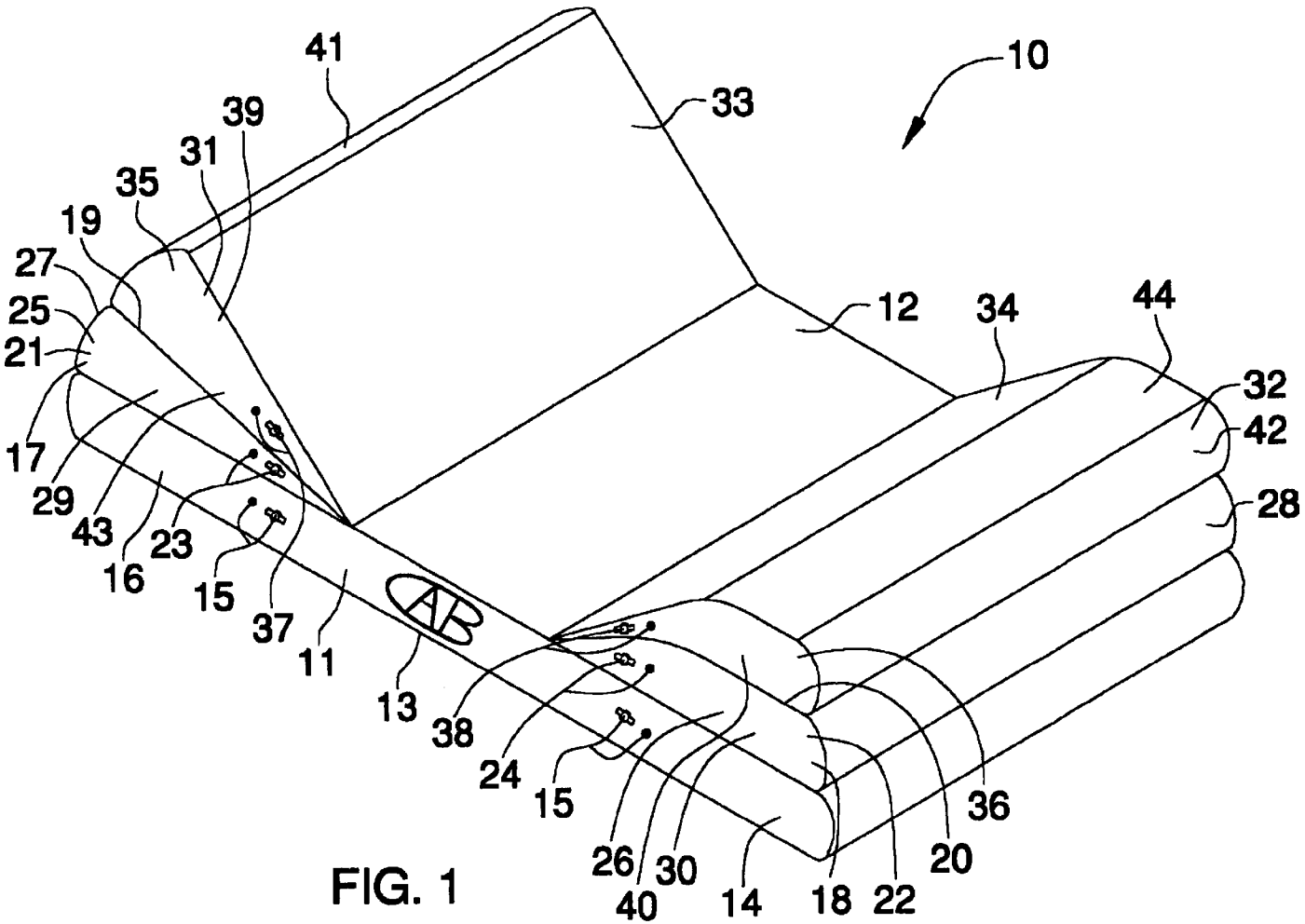
FIG. 1 is a perspective view of a new incline-adjustable air mattress according to the present invention and being deflated.
Figure 2:
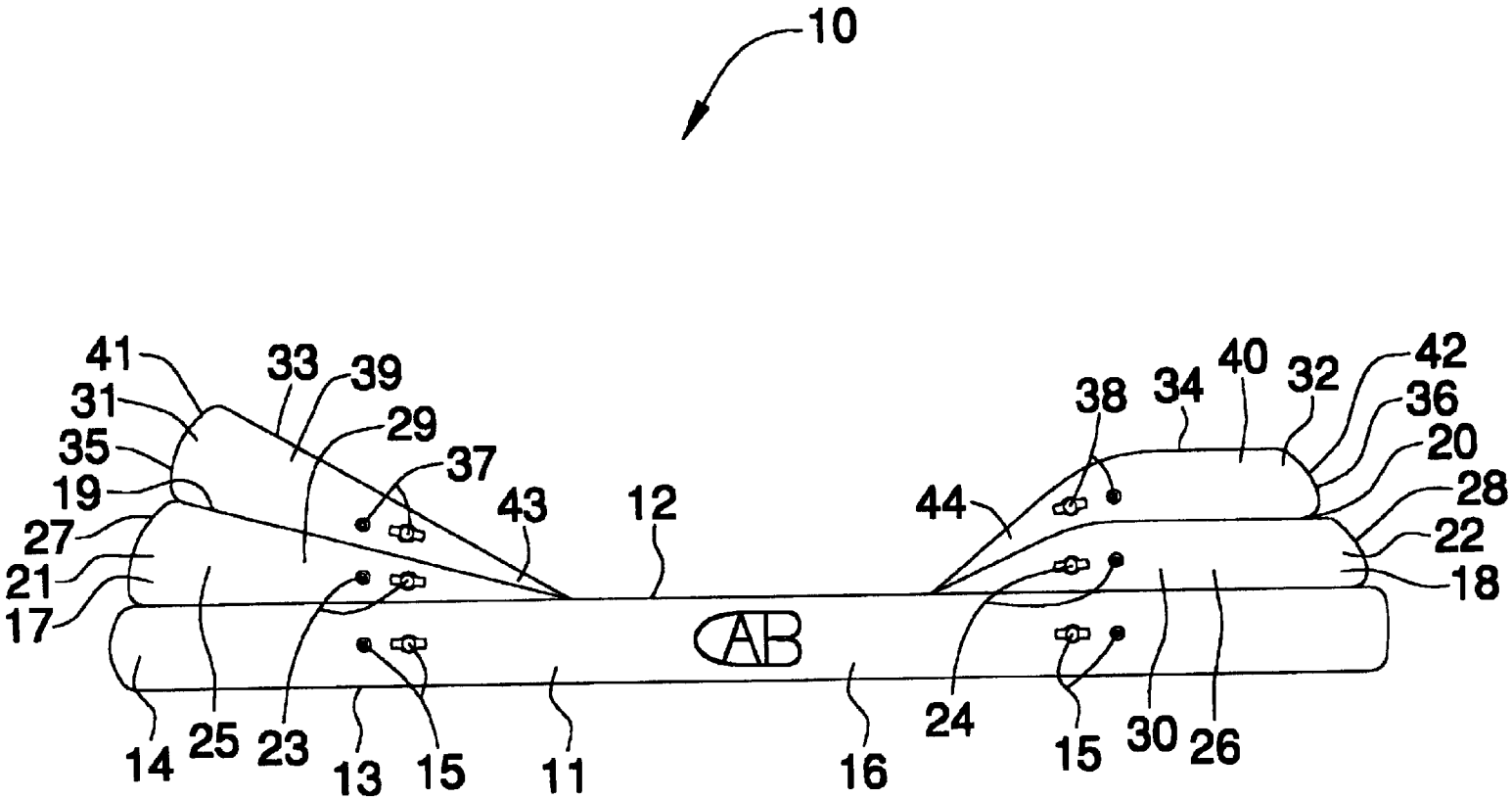
FIG. 2 is a side elevational view of the present invention being inflated.

With reference now to the drawings, and in particular to FIGS. 1 through 2 thereof, a new incline-adjustable air mattress embodying the principles and concepts of the present invention and generally designated by the reference numeral 10 will be described.

As best illustrated in FIGS. 1 through 2, the incline-adjustable air mattress 10 generally comprises a base section 11 having top, bottom and perimeter walls 12–14, and also having air valve members 15 being conventionally disposed in the perimeter wall 14, and further having an air chamber 16 being disposed between the top, bottom, and perimeter walls 12–14. The perimeter wall of the base section is generally an endless strip being disposed along edges of the top and bottom walls and has a width which is generally uniform throughout.

Intermediate sections 17, 18 are disposed upon and securely connected to the base section 11, and include a head intermediate section 17 being disposed upon a front portion of the base section 11, and also includes a foot intermediate section 18 being disposed upon a rear portion of the base section 11 and being spaced from the head intermediate section 17. Each of the intermediate sections 17, 18 has a main wall 19, 20 and a perimeter wall 21, 22 and also has air valves 23, 24 being conventionally disposed in the perimeter wall 21, 22. The perimeter wall 21, 22 of each intermediate section 17, 18 includes side and end walls 25–28. The side walls 25, 26 are tapered away from the end walls 27, 28. The intermediate sections 17, 18 have air chambers 29, 30 being disposed between the main walls 19, 20 and perimeter walls 21, 22 of the intermediate sections 17, 18 and the top wall 12 of the base section 11. Upon the air chamber 29 of the head intermediate section 17 being filled with air, the main wall 19 of the head intermediate section 17 is inclined at approximately 15 degrees relative to the top wall 12 of the base section 11. Also, upon the air chamber 30 of the foot intermediate section 18 being filled with air, the main wall 20 of the foot intermediate section 18 is curved.

Upper sections 31, 32 are disposed upon and conventionally connected to the intermediate sections 17, 18, and include a head upper section 31 being securely attached upon the head intermediate section 17, and also include a foot upper section 32 being securely attached upon the foot intermediate section 18 and being spaced from the head upper section 31. Each of the upper sections 31, 32 has a main wall 33, 34 and a perimeter wall 35, 36 and also has air valves 37, 38 being conventionally disposed in the perimeter wall 35, 36. The perimeter walls 35, 36 of the upper sections 31, 32 include side and end walls 39–42. The side walls 39, 40 of the upper sections 31, 32 are tapered away from the end walls 41, 42. The upper sections 31, 32 have air chambers 43, 44 being disposed between the main walls 33, 34 and the perimeter walls 35, 36 of the upper sections 31, 32 and the main walls 19, 20 of the intermediate section 17;18. Upon the air chambers 41, 42 of the upper sections 31, 32 being filled with air, the main walls 33, 34 of the upper sections 31, 32 are angled at approximately 30 degrees relative to the top wall 12 of the base section 11.

As discussed above, and clearly shown in the figures, the intermediate and upper sections, upon full inflation, are generally wedge shaped.

In use, the user fills the air chambers 16, 29, 30, 43, 44 with air from a conventional air pump with the main wall 19 of the head intermediate section 17 being inclined at an angle of approximately 15 degrees relative to the top wall 12 of the base section 11 and with the main wall 33 of the head upper section 31 being inclined at an angle of approximately 30 degrees relative to the top wall 12 of the base section 11 thus allowing the user to comfortably have one's head elevated relative to the rest of one's body.

As discussed above, and clearly shown in the figures, upon the full inflation of the base section, the intermediate sections, and the upper sections, the head of a user is elevated approximately 30 degrees from the top wall of the base section, and the user's legs are supported on a curved leg supporting surface of the foot upper section.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the incline-adjustable air mattress. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An incline-adjustable air mattress, adapted to elevate a user's head and legs relative to a user's torso, comprising:

a base section having a top, a bottom, and a perimeter wall comprised of an endless strip being disposed along edges of said top and bottom walls and has a width which is generally uniform throughout, with a plurality of air valve members disposed in the perimeter wall, having an air chamber disposed between said top bottom, and perimeter walls;

two inflatable, generally wedge shaped intermediate sections being disposed upon and connected to said base section; two inflatable, generally wedged shaped upper sections being disposed upon and connected to said intermediate sections;

said intermediate sections comprising a head intermediate section being disposed upon a front portion of said base section, and also comprising a foot intermediate section being disposed upon a rear portion of the said base section and being spaced from said head intermediate section; the head intermediate section having a main wall, which upon full inflation of the head intermediate section is inclined approximately 15 degrees relative to the top wall of the base;

said upper sections comprising a head upper section being attached upon said head intermediate section, and also comprising foot upper section being attached upon said foot intermediate section and being spaced from said head upper section, wherein upon the full inflation of the base section, the intermediate and upper sections, the head of a user is elevated approximately 30 degrees from the top wall of the base section, and the users legs are supported on a curved leg supporting surface of the foot upper section.

2. The incline-adjustable air mattress as described in claim 1, wherein said each of said intermediate section has a main wall and a perimeter wall and also has air valves being conventionally disposed in said perimeter wall, said perimeter wall of each said intermediate section including side and end walls, said side walls being tapered away from said end walls.

3. The incline-adjustable air mattress as described in claim 1, wherein each of said upper section has a main wall and a perimeter wall and also has air valves being disposed in said perimeter wall, said perimeter wall of each said upper section including side and end walls, said side walls of said upper sections being tapered away from said end walls of said upper sections.

* * * * *